US007900620B1

(12) United States Patent
Walters et al.

(10) Patent No.: US 7,900,620 B1
(45) Date of Patent: Mar. 8, 2011

(54) SLINGSHOT CONSTRUCTION

(76) Inventors: Wayne R. Walters, Fall Branch, TN (US); Robert W. Pannell, Kingsport, TN (US)

( * ) Notice: Subject to any disclaimer, the term of this patent is extended or adjusted under 35 U.S.C. 154(b) by 444 days.

(21) Appl. No.: 11/894,093

(22) Filed: Aug. 20, 2007

Related U.S. Application Data

(60) Provisional application No. 60/839,149, filed on Aug. 21, 2006.

(51) Int. Cl.
*F41B 3/02* (2006.01)

(52) U.S. Cl. ..... 124/20.1

(58) Field of Classification Search ..... 124/20.1, 124/24.1

See application file for complete search history.

(56) References Cited

U.S. PATENT DOCUMENTS

| | | | | |
|---|---|---|---|---|
| 2,996,060 | A * | 8/1961 | Appleby | 124/41.1 |
| 5,224,703 | A * | 7/1993 | Osher | 473/513 |
| 2003/0034019 | A1* | 2/2003 | Lewis | 124/20.1 |
| 2006/0191521 | A1* | 8/2006 | Gee | 124/20.1 |

* cited by examiner

*Primary Examiner* — John Ricci

(57) ABSTRACT

A slingshot for delivering (firing) a fragile, easily breakable shelled pellet such as a gelatin shelled game scent ball to a target site in a woods, field, or the like, whereby the pellet breaks apart at impact at the target site and disperses the scent, wherein a pellet carrying breech structure is affixed to the slingshot pouch or firing bands and is provided with an axially oriented pellet receiving cavity partly defined by flexible fingers which can hold the pellet in place when cocking the slingshot but which easily releases the pellet on firing.

17 Claims, 2 Drawing Sheets

SLINGSHOT CONSTRUCTION

This application claims priority under 35 U.S.C. 119(e)(1) based on Applicants Provisional 60/839,149 filed Aug. 21, 2006 and titled SCENT DELIVERY SYSTEM.

BACKGROUND OF THE INVENTION

1. Field of the Invention

The present invention concerns a unique slingshot specially adapted for propelling fragile pellets, balls or the like which contain game scent in liquid, powered or solid form, colored liquid such as paint or the like, and which easily breaks apart on impact to thereby disperse the liquid at a target site. Such pellets can be used, e.g., to hold and dispel game scent, food scent, cover scent, or the like within a desired hunting area.

2. Prior Art

As stated in U.S. Pat. No. 6,199,311 B1, and with respect to the need for a truly functional scented pellet delivery device, "Conventional methods of applying game scent, require a hunter to walk to a given location and apply the scent by tying a scent-laden strip of cloth to a tree or bush or by actually applying the scent to active scrapes or rubs. This method requires the hunter to walk to each location to be scented. This causes human scent, which repels game, to be left across the area traversed including possibly the game trail. As such, this method has the potential of repelling, as opposed to attracting game."

Further in this regard, prior game scent filled pellets which are intended to break apart upon striking a target such as, e.g., a tree, branch, stump, ground or leafy bush, must be highly fragile such that impact of the pellet against a bush or the like which has a lot of "give" will still shatter the pellet.

Many pellet delivery devices have been suggested in the literature regarding game scented pellets, including a slingshot (see U.S. 2003/0034019 A1), however, no slingshot structure in particular, or other delivery device is known to the art which can fire highly fragile pellets—consistently—without premature breakage of the pellet. In this regard, e.g., when a fragile pellet is placed in the pouch of a slingshot and the pouch squeezed during cocking (stretching) of the firing bands, the sideways finger pressure on the pouch can easily rupture the pellet—before it is even fired.

Some of the game scents, for example, which can be contained in such pellets or balls include doe estrous, doe, buck, fox, rabbit, skunk or elk urine.

SUMMARY OF THE INVENTION

The above disadvantages of the prior art devices are overcome by the present invention which in a preferred embodiment utilizes the basic structure of a slingshot including a handle, a pair of spaced arms extending from an end of the handle in the general confirmation of a fork, a pair of elastic firing bands or members each being connected at its distal end to an arm, and each being connected at its proximal end to a pouch, and which in addition utilizes a pellet breech structure which can hold the pellet without the pellet inadvertently falling out of the breech, and wherein the breech is affixed to the pouch in such a manner that the finger grip on the pouch during cocking of the firing members places zero pressure on the pellet.

BRIEF DESCRIPTION OF THE DRAWINGS

The invention will be further understood from the drawings and their description herein wherein.

DETAILED DESCRIPTION

Figure 3:
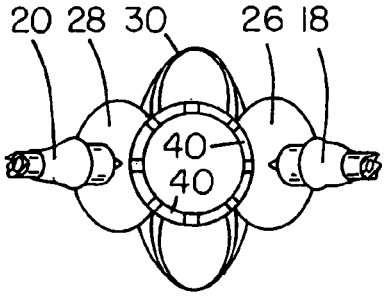
FIG. 3 is a cross-sectional view taken along line 3-3 in FIG. 1 with the pellet removed.
Figure 1:
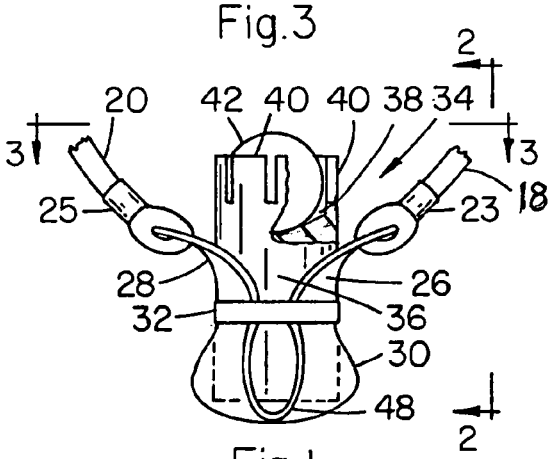
FIG. 1 is a top plan view of a slingshot to which a preferred form of the present breech structure, partially in cross-section is affixed.
Figure 2:
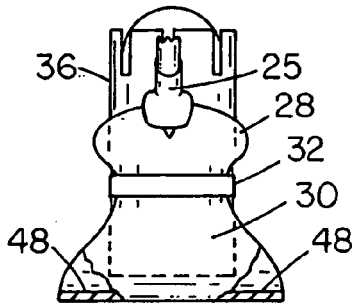
FIG. 2 is a side view taken along line 2-2 in FIG. 1 with the pellet removed.

Referring to the drawings, the present slingshot generally designated 11, in a preferred embodiment comprises handle 12 having spaced arms 14 and 16, a pair of elastic firing bands or members 18 and 20, each member being affixed at its distal end 22, 24 to an arm, and each member being affixed at its proximal end 23, 25 to an ear 26, 28 of a pouch 30. The pouch is affixed to the breech structure 34 described further below by means, e.g., of a plastic tie band, tie wire, metal snap ring, adhesive, screw, stitching, rivet or the like 32 tightened into peripheral groove or indent 33 in body portion 36 of the breech structure 34.

This breech structure 34 can be of metal, wood, or any rigid material, but preferably is of plastic material such as PET, polyurethane, cellulose ester, or Nylon and of circular cross-section, and having a pellet receiving cavity 38 formed, in part, by a plurality of, e.g., 4-10 flexible fingers 40. It is preferred that the finger dimensions, flexibility and composition, and the diameter and composition of pellet 42 be balanced such that the frictional resistance between the pellet and fingers shall require a direct downward pull weight (W) on the pellet of from about 0.1 oz. to about 20.0 oz., preferably from about 0.1 to about 2.0 oz., in order to extract the pellet from cavity 38. Such structure will make it easy to load and fire the pellet without placing frictional and acceleration stresses on the pellet during ejection thereof from the breech. Where (W) is too high the frictional stresses could break the fragile pellet apart. The exterior shape of the breech can be oval, square, cylindrical (as shown), or any other configuration depending on the shape of the pellet to be used.

Figure 4:
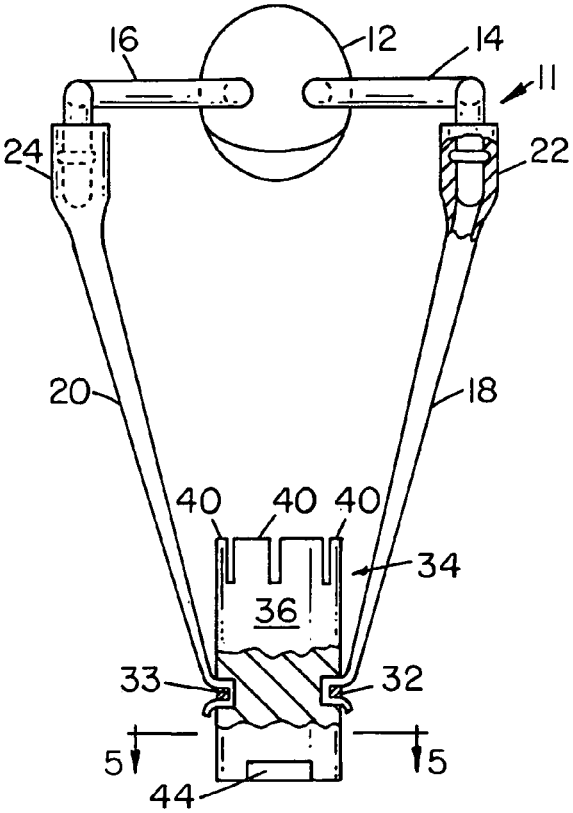
FIG. 4 is a view as in FIG. 1 showing an embodiment of the present breech structure without the pellet, and showing a direct attachment of the firing members to the breech structure.
Figure 1A:
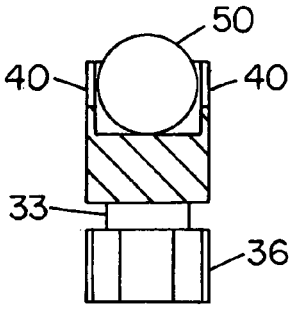
FIG. 1A shows a variation of the pellet receiving cavity of FIG. 1.
Figure 5:
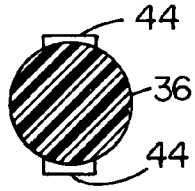
FIG. 5 is an end view of the breech structure of FIG. 4 taken along line 5-5 in FIG. 4.
Figure 6:
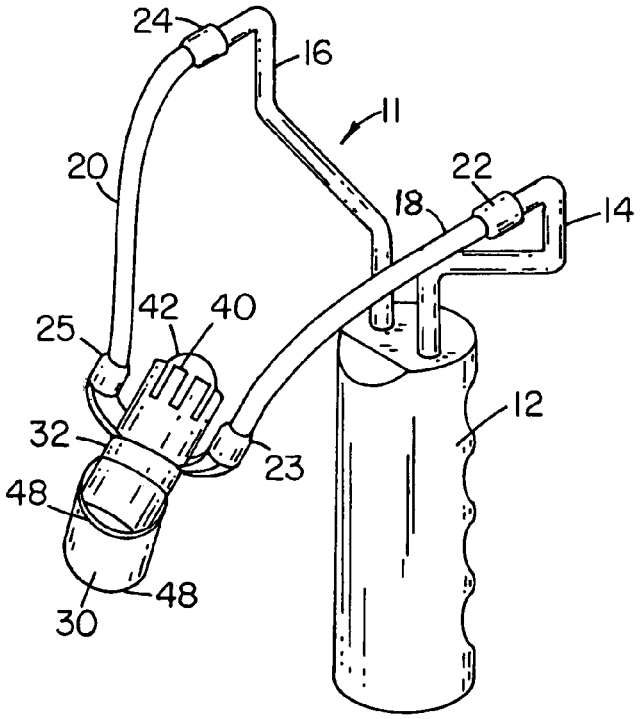
FIG. 6 is a generally sideways perspective view of the slingshot of FIG. 1.
Figure 7:
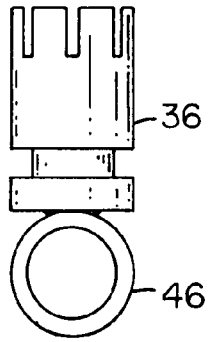
FIG. 7 is a side view of the breech structure of FIGS. 1 and 4 showing a variation of the shooters finger grip shoulder means.
Figure 8:
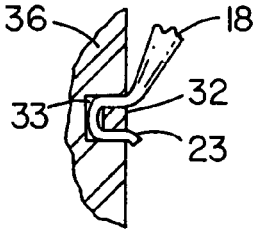
FIG. 8 is an enlarged view of the connection of the firing members to the breech in FIG. 4.
Figure 9:
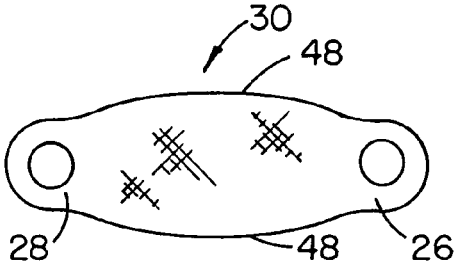
FIG. 9 is a layout of the pouch in FIG. 1.

Referring to FIGS. 4, 5 and 7, two shapes of finger grip shoulders 44 and 46 are shown. These shoulders are the equivalents in function of shoulders 48 provided by pouch 30. Any configuration of such shoulders which are comfortable for the shooter to grasp may be used as long as they do not interfere with the firing. Again it is noted that regardless of the finger pressure on any of these shoulders, no such pressure is applied to the fragile pellet.

Figure 10:
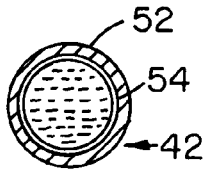
FIG. 10 is a cross-sectional view of a preferred pellet.
Figure 11:
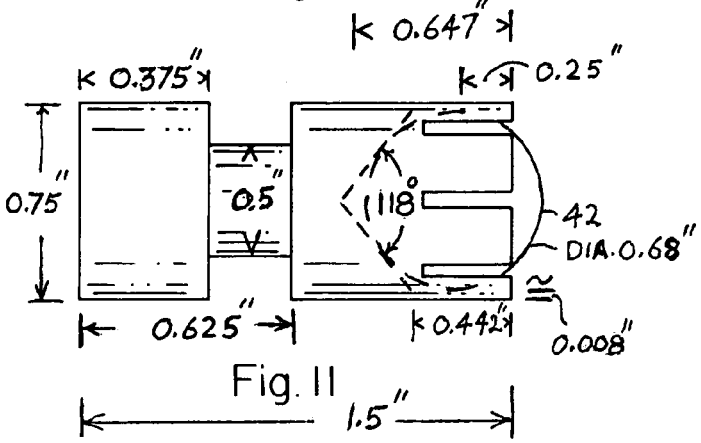
FIG. 11 is a side view of the breech structure of FIG. 1 with typical dimensions shown in inches.
Figure 12:
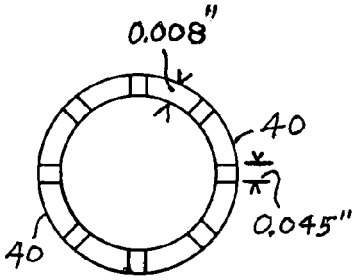
FIG. 12 is a distal end view of the breech structure of FIG. 1 with typical dimensions shown in inches.

Referring to FIG. 10, the pellet 42 in one preferred embodiment comprises an outer shell 52 of gelatin having an inner cavity 54 of paraffin. Certain preferred characteristics of the present pellet are that: the scent material is totally encapsulated in the pellet; a color marker can be used to let the enthusiast know what scent they are using including but not limited to food scents, urines, cover scents, gland extracts, attractants, etc.; the pellet can be round, oval, or any other shape of rigid or semi-rigid structure; the scent or other material can be natural or synthetic and can be solid, powder liquid, or gaseous; the outer shell can be formed by gelatinous based technology that is used in the paint ball and pharmaceutical industries and can be formed also from waxes, e.g., Paraffin; or can be composed of rubber (butyl, iso-butyl, styrenic, but not limited to these examples), or can be made of vinyl alcohols, e.g., ethyl vinyl, poly (vinyl), but not limited to these examples), or poly-plastics including but not limited to polyvinylchlorides, polyethylene, and polypropylene, or resins including but not limited to Epoxy, urethane, or cyanoacrylates.

The colored marker can be colored with any material that is a liquid, powder, solid or gaseous composition (e.g., a dye). This material can be biodegradable. Colored pellets can be utilized to identify the different types of scents.

These are just a few examples but not limited to:

a. Red—doe in estrous b. Yellow—doe urine c. Brown—for cover scents d. Green—food scents or any combination thereof.

The usage of delivery capsules has been prevalent in the pharmaceutical industry. The history of gelatin capsulation comes from a machine developed by Robert Scherer (U.S. Pat. No. 1,970,396). Two wide ribbons of gelatin are heat formed into two round pieces that are pressed together as the filling material for the capsule is being injected into the center. The capsule is rubbery and soft. The capsule becomes usable after cooling to room temperature. The formation for the outer shell of the present capsules (pellet) is the same as it is used in the pharmaceutical industry. It consists of a gelatin (CAS Number 9000-70-8) sphere, orb, oval, etc. The reason for the gelatin is that the material is biodegradable, of low-odor, and is commercially available. Other components which may be incorporated include low volatile silicone as a plasticizer or binding agent. Suppliers of the capsules include Cardinal Health, Oral Technologies, and Torpac.

The present pellet preferably employs an inner coating modification. The interior of the pellet or capsule preferably is coated with either paraffin wax (CAS Number 8000-74-2) or with low volatile silicone. In order to achieve the coating, the paraffin can be melted or liquefied to a semi-homogeneous consistency. Allowing the wax to slightly cool, it is then gently poured into the interior of the capsule and allowed to solidify. At this point this capsule is in multiple, i.e., 2 or more pieces. The silicone material can be added to the capsule's interior as it exists in pieces or as a final assembled system. In either case the silicone in liquid is poured into the interior or injected there into with a small gauge needle (i.e., 28 gauge or less) and is allowed to dry.

The urine or other scent or cover can be placed into the capsule in two ways. The first method is to pour or place the liquid into, e.g., one half of the capsule. For this method the empty portion(s) are taken to a heating element to soften their edges. As soon as the softening occurs, the softened portion is placed onto the piece containing the liquid scent. The pieces will seal together after allowing the pieces to cool to ambient conditions. The second half of the capsule will remain unfilled. The second method is to take the assembled capsule and inject, e.g., urine/liquid into the interior thereof using a small gauge needle (i.e., 28 gauge or less). In the case of the second method, the ball can be completely filled.

The present pellet can be any form of round, square or any shape that can be produced (including standard capsule, oval, etc.). The thickness of the outer shell and the interior coatings are variable. Both of these thickness can vary, e.g., from 0.0001 mm to 30 mm.

A useful structural material for the breech is the plastic PET—Poly (ethylene terephthalate). A typical high MW such as PET has the properties give below.

| PET | |
|---|---|
| Density | 1370 kg/m$^3$ |
| Young Modulus (E) | 2800-3100 MPa |
| Tensile Strength ($0_+$) | 55-75 Mpa |
| Elongation at Break | 50-150% |
| Notch Test | 3.6 kJ/m$^2$ |
| Glass Temperature | 75° C. |
| Melting Point | 260° C. |
| Vicat B | 170° C. |
| Thermal Conductivity | 0.24 W/m · K |
| Linear Expansion Coefficient ($\alpha$) | $7 \times 10^{-5}$/K |
| Specific Heat (c) | 1.0 kJ/kg · K |
| Water Absorption (ASTM) | 0.16 |

Source: A. K. varn der Vegt & L. E. Govaert, Polymeren, van keten tot kunstof, ISBN 90-407-2388-5

The gelatin material useful for the present pellet is produced from the partial hydrolysis of Collagen (protein) in which the strands of Collagen are subjected to heat and then rearrange upon cooling to form a new bonded structure (Gelatin). There are many different methods to produce Gelatins from Collagen. Collagen primarily comes from the connective tissues of animals. This includes, but is not limited to, cows, horses, and pigs. More recently, the Collagens have been isolated from fish. This is in response to individuals that have objections arising from religious beliefs in the consumption of animals.

To make a distinction, Gelatins are derived from animals, whether that is terrestrial or oceanic. "Vegetable gelatins" are another class that includes agar, pectin, and nature gum to name a few. Although these do exhibit gel type properties, these materials are carbohydrates and not proteins. Therefore, there is no chemical relationship between the two types of material. One overriding issue is seen with gelatins of any form. These materials are highly hydrophilic. The slightest amount of water will cause the bonds to begin to relax and break within a matter of a short time span. The time span varies due to the conditions in which the gelatin was originally produced.

Some useful types of fragile waxes for both the outer shell or inner coating of the pellet include the paraffins, a broad class of alkanes. These alkanes are of the general chemical formula of $C_nH_{2n+2}$. In terms of a wax, paraffin wax has a chemical formula of $C_{25}H_{52}$. This substance is a white, odorless solid that has no taste. Below is a table summarizing the properties of this substance.

| Paraffin Wax Properties | |
|---|---|
| Melting Point | 47-64° C. |
| Electrical Resistivity | $10^{13}$ to $10^{17}$ Ωm |
| Heat Capacity | 2500-2800 J/(kg K) |
| Heat of Fusion | 200-200 kJ/kg |

The silicones which may be used include the general classification of materials that have the chemical formula of $(R_2SiO)_n$ where the R can be a methyl ($CH_3$), ethyl ($CH_2$—$CH_3$), or a phenyl group (Ring structure). These materials are commonly referred to as polysiloxanes. The properties of these materials are listed below and can be solids or liquids:

1. Thermal stability (Constancy of properties over a wide operating range of −100 to 250° C.);
2. Though not lipophilic they have the ability to repel water and form watertight seals;
3. Excellent resistance to oxygen, ozone, and sunlight;
4. Flexibility;
5. Good electrical insulation;
6. Anti-adhesive;
7. Low chemical reactivity;
8. Low toxicity;
9. High gas permeability: at room temperature (25° C.) the permeability of silicone rubber for gases like oxygen is approximately 400 times that a butyl rubber, making silicone useful for medical applications (though precluding it from applications where gas-tight seals are necessary).

Employing Gelatin as the outer shell of the pellet, the commercially available balls (pellets) have a thickness variation due to the supplier. These thicknesses can normally range from 0.01 mm up to 3.0 mm depending on production run and due to customer needs. The set-up for these balls are done by the manufacturer to accommodate the ribbon of gelatin needed to produce the desired ball dimensions. If a paraffin is used for the outer shell, variation will be seen in the thickness due to sagging of the material if it is poured, cast, etc. into a mold or is a ball shape bored out of a solid block of the wax material. Either way, the thickness dimensions of the shell preferably should average from about 0.01 mm up to about 5.0 mm.

With the use of a gelatin outer shell an inner protective coating such as the aforesaid paraffin wax should be added (coated onto) to the interior surface of the outer shell. This coating is meant to keep the urine liquid from dissolving the outer shell. The inner coating can be poured, sprayed, or rolled inside the shell, and its thickness can vary due to the technique used. The range of the thickness can vary from about 0.0001 mm to about 4 mm depending upon the required hydrophobicity of the coating needed. In using a Paraffin outer shell, the inner coating may not be necessary since the wax provides an excellent hydrophobic barrier. However, for thinner Paraffin outer shell thicknesses, an inner coating can be employed as stated above.

The invention has been described in detail with particular reference to preferred embodiments thereof, but it will be understood that variations and modifications will be effected with the spirit and scope of the invention.

We claim:

1. A slingshot for firing a fluid filled pellet having a fluid containment shell of fragile material which is readily breakable upon impacting a target, said slingshot comprising a handle section with an upper end connected to two spaced arms, a pair of elastic firing members each having a distal end connected to a different one of said arms and each having a proximal end attached to a pellet firing breech means having a body portion with a firing axis, generally axially extending wall segments protruding from said body portion to form a distally opening pellet receiving cavity formed around said firing axis, said wall segments being flexible to allow a pellet to be inserted into said cavity and be held in place by said wall segments without said wall segments applying pellet breaking frictional resistance to release of said pellet upon firing the slingshot, pellet positioning stop shoulder structure on said breech means for engaging said pellet and preventing insertion thereof into said cavity beyond a point where said wall segments are out of contact with said pellet prior to firing, grip means positioned on said breech means at a location isolated from said wall segments such that a shooter will not apply pressure to said segments during firing of the slingshot, wherein 4-8 substantially equally circularly spaced wall segments are provided, wherein said segments are from about ⅛ in. to about ½ in. long in a generally axial direction and have a wall thickness of from about 0.001 in. to about 0.06 in., and wherein said segments provide an inner surface diameter to said cavity of from about ½ in. to about 1.0 in.

2. The slingshot of claim 1 wherein said body portion of said breech means is attached directly to said elastic firing members.

3. The slingshot of claim 1 wherein said grip means is formed on said body portion to provide a finger grip for assisting in pulling said breech means along said firing axis against the resistance of said elastic firing members.

4. The slingshot of claim 1 wherein a pellet is held in said cavity ready for firing.

5. The slingshot of claim 4 wherein inside surface portions of said wall segments form said cavity with a substantially circular cross-section, wherein 4-8 substantially equally circularly spaced wall segments are provided, wherein said segments are from about ⅛ in. to about ½ in. long in a generally axial direction and have a wall thickness of from about 0.001 in. to about 0.06 in., and wherein said segments provide an inner surface diameter to said cavity of from about ½ in. to about 1.0 in., wherein said pellet is round and has an outside diameter of up to about 0.005 in. greater than said inside diameter of said cavity.

6. The slingshot of claim 5 wherein the outer surface of said pellet and said inner wall surface of said cavity are smooth and wherein a downward pull weight of from about 0.1 oz. to about 2.0 oz. is required to extract said pellet from said cavity.

7. The slingshot of claim 5 wherein a pellet containing a paint or game scent fluid material is secured in said cavity ready for firing, and wherein said pellet is spherical and comprises an outer paraffin wax shell of a thickness of about 0.01 mm to about 3.0 mm.

8. The slingshot of claim 7 wherein said scent material is one or more materials selected from game animal urine or musk.

9. The slingshot of claim 1 wherein said breech means is elongated and has a substantially uniform outside diameter along its entire length.

10. A slingshot for firing a fluid filled pellet constructed with a fluid containment shell of fragile material which is readily breakable upon impacting a target, said slingshot having a handle section connected to two spaced arms, a pair of elastic firing members each having a distal end connected to a different one of said arms and each having a proximal end attached to a pellet firing breech means having a firing axis and proximal and distal end portions, a plurality of flexible fingers on said distal end portion of said breech means and extending generally axially and proximally therefrom to form a distally opening pellet receiving cavity formed substantially symmetrically around said firing axis, said cavity terminating proximally in a floor against which said pellet can be seated, said floor being generally axially and proximally spaced from said fingers a distance which is limited such that a periphery of said pellet frictionally engages said fingers prior to firing the slingshot, grip means positioned on said breech means for allowing a shooter to grip the breech means without applying force against said fingers, said fingers being flexible to allow a pellet to be inserted into said cavity and be held in place by said fingers without a firm grip by the shooter of the breech means applying frictional resistance to the release of said pellet upon firing the slingshot, whereby said shell is not broken by way of said firing.

11. The slingshot of claim 10 wherein said cavity is substantially circular in cross-section and wherein said grip means comprises one or more shoulder segments.

12. The slingshot of claim 10 wherein said breech means is affixed to a pouch of a slingshot, wherein said pouch is formed with a middle portion and opposite end portions, which end portions provide attachment ears for said firing members.

13. A slingshot for firing a fluid filled pellet having a fluid containment shell of fragile material which is readily breakable upon impacting a target, said slingshot comprising a handle section with an upper end connected to two spaced arms, a pair of elastic firing members each having a distal end connected to a different one of said arms and each having a proximal end attached to a pellet firing breech means having a body portion with a firing axis, generally axially extending wall segments protruding from said body portions to form a distally opening pellet receiving cavity formed around said firing axis, said wall segments being flexible to allow a pellet to be inserted into said cavity and be held in place by said wall segments without said wall segments applying pellet breaking frictional resistance to release of said pellet upon firing the slingshot, pellet positioning stop shoulder structure on said breech means for engaging said pellet and preventing insertion thereof into said cavity beyond a point where said wall segments are out of contact with said pellet prior to firing, grip means positioned on said breech means at a location isolated from said wall segments such that a shooter will not apply pressure to said segments during firing of the slingshot, and wherein said body portion of said breech means is affixed to a pouch of a slingshot, wherein said pouch is formed with a middle portion and opposite end portions, which end portions provide attachment ears for said firing members.

14. The slingshot of claim 13 wherein said pouch is formed with a shoulder structure which provides a finger grip for assisting in pulling said breech means along said firing axis against the resistance of said elastic firing members.

15. The slingshot of claim 13 wherein said pouch is formed with diametrically opposite ear portions which provide points of attachment for said firing members.

16. The slingshot of claim 15 wherein said proximal end of each said elastic firing member passes thru an aperture in an associated ear portion and is tied off.

17. The slingshot of claim 13 wherein a section of said middle portion of said pouch is attached to said body portion by being compressed by ring means fitted into a circumferential groove formed in a periphery of said body portion.

* * * * *